US007934758B2

(12) United States Patent
Stamey et al.

(10) Patent No.: US 7,934,758 B2
(45) Date of Patent: May 3, 2011

(54) SYSTEMS AND METHODS FOR CONNECTING AND ADAPTING A GRAPPLE ASSEMBLY

(75) Inventors: John Stamey, Manhattan, KS (US); John Kevin Clemons, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 1068 days.

(21) Appl. No.: 11/693,948

(22) Filed: Mar. 30, 2007

(65) Prior Publication Data

US 2008/0238116 A1 Oct. 2, 2008

(51) Int. Cl.
*B66C 1/42* (2006.01)

(52) U.S. Cl. ..... 294/106

(58) Field of Classification Search ..... 294/106, 294/119.4; 188/83, 366, 71.1; 414/731, 414/739, 734

See application file for complete search history.

(56) References Cited

U.S. PATENT DOCUMENTS

| | | | |
|---|---|---|---|
| 3,954,194 | A | 5/1976 | Stedman |
| 3,972,431 | A | 8/1976 | Fischer |
| 3,994,325 | A | 11/1976 | Cryder et al. |
| 4,077,445 | A | 3/1978 | Wirt |
| 4,081,036 | A | 3/1978 | Yokoyama |
| 4,113,124 | A | 9/1978 | Muntjanoff |
| 4,114,666 | A | 9/1978 | Bruun |
| 4,140,233 | A | 2/1979 | Muntjanoff et al. |
| 4,201,510 | A | 5/1980 | Muntjanoff |
| 4,260,323 | A | 4/1981 | Muntjanoff |
| 4,313,633 | A | 2/1982 | Muntjanoff et al. |
| 4,379,674 | A | 4/1983 | Meisel, Jr. et al. |
| 4,379,675 | A | 4/1983 | Muntjanoff et al. |
| 4,413,945 | A | 11/1983 | LaBounty |
| 4,426,110 | A | 1/1984 | Mitchell et al. |
| 4,452,479 | A | 6/1984 | Terai et al. |
| 4,529,239 | A | 7/1985 | Ogawa |
| RE31,991 | E | 9/1985 | Descoteaux et al. |
| 4,538,848 | A | 9/1985 | Aberkrom |
| 4,542,929 | A | 9/1985 | Possinger |
| 4,553,778 | A | 11/1985 | Tyer |
| 4,558,515 | A | 12/1985 | LaBounty |
| 4,572,567 | A | 2/1986 | Johnson |
| 4,573,728 | A | 3/1986 | Johnson |
| 4,576,406 | A | 3/1986 | Johnson |
| 4,606,694 | A | 8/1986 | Meisel, Jr. et al. |
| 4,609,081 | A | 9/1986 | Hungerford |
| 4,679,839 | A | 7/1987 | Damron |
| 4,682,931 | A | 7/1987 | House |
| 4,697,509 | A | 10/1987 | LaBounty |
| 4,697,840 | A | 10/1987 | Duncan |
| 4,703,968 | A | 11/1987 | LaBounty |
| 4,715,641 | A | 12/1987 | Palmer |

(Continued)

OTHER PUBLICATIONS

Allied Construction Products, LLC, "Variable Mounting System™" (product brochure) Form No. VMS 2/02-5M (2002).

(Continued)

*Primary Examiner* — Paul T Chin
(74) *Attorney, Agent, or Firm* — Leydig, Voit & Mayer

(57) ABSTRACT

A connecting and adapting system for interconnecting a pair of jaws of a grapple assembly and for adapting the grapple assembly for connecting to a plurality of linkages. The system includes bearings, where the bearings have a flange, an elongated section, and a bore. The flange of the bearings abuts a portion of one of the jaws, the elongated section of the bearings interconnects the jaws, and the bore of the bearing receives a pin to provide a connecting location. A portion of the bearing, being positioned opposite the flange, receives a collar that abuts a portion of one of the jaws.

16 Claims, 8 Drawing Sheets

U.S. PATENT DOCUMENTS

| | | | |
|---|---|---|---|
| 4,717,191 | A | 1/1988 | Farmer |
| 4,723,639 | A | 2/1988 | Hungerford |
| 4,771,540 | A | 9/1988 | LaBounty |
| 4,807,918 | A | 2/1989 | Weeks |
| 4,810,020 | A | 3/1989 | Powell |
| 4,818,005 | A | 4/1989 | Purser |
| D306,599 | S | 3/1990 | Hunter |
| 4,907,356 | A | 3/1990 | LaBounty |
| 5,024,397 | A | 6/1991 | Edwards et al. |
| 5,061,150 | A | 10/1991 | Rentschler |
| 5,073,080 | A | 12/1991 | Blum |
| 5,096,247 | A | 3/1992 | Killen |
| 5,110,169 | A | 5/1992 | Shepherd et al. |
| 5,141,387 | A | 8/1992 | Smith |
| 5,150,936 | A | 9/1992 | Avery |
| 5,193,873 | A | 3/1993 | Juliusz et al. |
| 5,209,536 | A | 5/1993 | Rogers, Sr. et al. |
| 5,219,265 | A | 6/1993 | Recker |
| 5,267,594 | A | 12/1993 | Wiemeri et al. |
| 5,328,223 | A | 7/1994 | Maggio |
| 5,330,242 | A | 7/1994 | Lucky, Sr. |
| 5,335,955 | A | 8/1994 | Pekka et al. |
| 5,411,304 | A | 5/1995 | Muto et al. |
| 5,417,464 | A | 5/1995 | Seaberg et al. |
| 5,441,090 | A | 8/1995 | Hill et al. |
| 5,451,087 | A | 9/1995 | Beaulieu |
| 5,472,249 | A | 12/1995 | Fiedler |
| 5,472,308 | A | 12/1995 | Somero |
| 5,540,050 | A | 7/1996 | Krupowicz |
| 5,558,380 | A | 9/1996 | Meyer et al. |
| 5,579,816 | A | 12/1996 | Hill et al. |
| 5,593,199 | A | 1/1997 | Fandrich et al. |
| 5,601,161 | A | 2/1997 | Brigden |
| 5,607,251 | A | 3/1997 | Rafn |
| 5,613,722 | A | 3/1997 | Fandrich et al. |
| 5,620,298 | A | 4/1997 | Barwise |
| 5,653,489 | A | 8/1997 | Fandrich et al. |
| 5,730,430 | A | 3/1998 | Hodson et al. |
| 5,762,388 | A | 6/1998 | Futa |
| 5,788,300 | A | 8/1998 | Dickison et al. |
| D403,000 | S | 12/1998 | Leach |
| 5,863,086 | A | 1/1999 | Christenson |
| 5,865,492 | A | 2/1999 | Horton |
| 5,865,594 | A | 2/1999 | Kim |
| 5,873,615 | A | 2/1999 | McCullough |
| D408,609 | S | 4/1999 | Oja et al. |
| 5,890,754 | A | 4/1999 | Murr |
| 5,918,923 | A | 7/1999 | Killion |
| 5,927,665 | A | 7/1999 | Grabnic |
| 5,971,455 | A | 10/1999 | Wolin et al. |
| 5,975,604 | A | 11/1999 | Wolin et al. |
| 6,065,513 | A | 5/2000 | Paakkunainen |
| 6,119,824 | A | 9/2000 | McCallum |
| 6,123,376 | A | 9/2000 | Yakushinji |
| 6,126,216 | A | 10/2000 | Tollefson |
| 6,131,978 | A | 10/2000 | Rounds |
| 6,155,619 | A | 12/2000 | Kirkpatrick et al. |
| 6,168,219 | B1 | 1/2001 | Futa |
| 6,176,531 | B1 | 1/2001 | Wheeler |
| 6,206,440 | B1 | 3/2001 | McCallum |
| 6,244,643 | B1 | 6/2001 | Tillaart |
| 6,257,636 | B1 | 7/2001 | Hovis et al. |
| 6,264,013 | B1 | 7/2001 | Hodgins |
| 6,266,901 | B1 | 7/2001 | Kanda et al. |
| 6,267,547 | B1 | 7/2001 | Lund |
| 6,315,344 | B1 | 11/2001 | Mattson et al. |
| 6,347,690 | B1 | 2/2002 | McCallum |
| 6,382,274 | B1 | 5/2002 | Hicks |
| 6,398,282 | B1 | 6/2002 | Mononen |
| 6,412,837 | B2 | 7/2002 | Futa |
| 6,457,761 | B1 | 10/2002 | Benoit |
| 6,655,899 | B1 | 12/2003 | Emerson |
| D496,945 | S | 10/2004 | Daniel |
| 6,820,357 | B1 | 11/2004 | Menard et al. |
| 6,824,181 | B2 | 11/2004 | Samper et al. |
| 7,083,002 | B2 | 8/2006 | Matsumoto et al. |
| 2001/0015560 | A1 | 8/2001 | Futa |
| 2002/0158479 | A1 | 10/2002 | Schierholz |
| 2004/0004362 | A1 | 1/2004 | Love |

OTHER PUBLICATIONS

Allied Construction Products, LLC, "Contractor's Mechanical Grapple" (product brochure) Form No. Grapple 4/04-5M (2004).

Breaker Technology, Inc., "HG Series Demolition Grapples" (product brochure), 10190-ENG-05/01 (May 2001).

Ironworks International, Inc., "Grapples" (product brochure), (Sep. 15, 2004).

LaBounty Hydraulic Tools Product Group of the Stanley Works, Grapple.

SYSTEMS AND METHODS FOR CONNECTING AND ADAPTING A GRAPPLE ASSEMBLY

TECHNICAL FIELD

The present disclosure relates generally to systems and methods for connecting and adapting a grapple assembly and, more particularly, to systems and methods for interconnecting components of a grapple assembly and for adapting the grapple assembly for connection to a linkage system.

BACKGROUND

A grapple is a generally well known type of work tool that is often attached to heavy machinery (e.g., grapples are often attached to the arm of an excavator). Such grapples are hereinafter referred to as "grapple assemblies." One primary use for a grapple assembly is to provide an excavator with gripping and handling capability. This gripping and handling capability makes the excavator suitable for a variety of operations. For example, excavators employing grapple assemblies are often used in primary and secondary demolition. In primary demolition, excavators employing grapple assemblies are used to tear down lightweight structures made of wood or brick. In secondary demolition, excavators employing grapple assemblies are used for sorting, picking, placing, and loading materials.

Typically, grapple assemblies include an upper and lower jaw, the jaws being oppositely arranged, where an end of each jaw is connected to a first pin. A known way to secure the first pin to the grapple assembly, yet allow the grapple assembly to open and close, is to fixedly attach the first pin to the lower jaw and to rotatably attach the upper jaw to the first pin. This enables the upper jaw to rotate about the pin, in a first and second direction, for opening and closing the grapple assembly. Because the first pin is fixedly attached to the lower jaw, the lower jaw cannot rotate independent of the first pin. Similarly, the first pin cannot rotate independent of the lower jaw.

Linkage systems connect the grapple assembly to the arm of an excavator. A typical linkage system is permanently fixed on the arm of an excavator and connects to the first pin and a second pin of the grapple assembly, where the second pin is typically located on the upper jaw. These linkage systems are often non-adjustable and manufactured for connection to specific types and sizes of pins. That is, the linkage systems are not adjustable for connecting to different types and sizes of first and second pins. Similarly, the first and second pins of known grapple assemblies cannot be adjusted for connecting to different types and sizes of linkages systems. If the first and second pins of the grapple assembly are not compatible with the particular linkage system, then the grapple assembly cannot be connected to the excavator. Accordingly, it would be desirable to provide a grapple assembly that is adaptable for connecting to a multiplicity of sizes and types of linkage systems.

A quick coupler is a type of linkage system that grabs the first and second pins located on the jaws of a grapple for quickly connecting the grapple assembly to the arm of the excavator. This connection between the quick coupler and the pins is one in which the pins should not move, e.g., rotate, inside of the quick coupler because such movement could cause the pins to slip out of the quick coupler. To open and close the grapple assembly, the quick coupler rotates about an axis located proximate to the first pin, thereby moving the upper jaw, in a first and second direction, relative to the lower jaw. However, and as previously described, the first pin of a typical grapple assembly is fixedly attached to the lower jaw and unable rotate independent of the lower jaw. Accordingly, typical grapple assemblies are not well suited for use with a quick coupler because, when the quick coupler rotates for opening and closing the grapple assembly, the first pin, because it is fixedly attached to the lower jaw, will rotate inside of the quick coupler. This can cause the grapple assembly to unexpectedly disconnect from the quick coupler. Accordingly, it would be desirable to provide a grapple assembly better suited for use with a quick coupler.

BRIEF SUMMARY

This disclosure describes, in one aspect, a grapple assembly including a connecting and adapting system. The grapple assembly includes first and second opposed jaws, each jaw has a connected end and a free end, each connected end includes a projection that has first and second sides and at least one aperture, the aperture of the first jaw is axially aligned with the aperture of the second jaw. The grapple assembly further includes a bearing that has a first end and a second end. The bearing comprises: an elongated section extending between the first and second ends of the bearing, the elongated section is positioned in the aperture of each jaw for connecting the jaws together; a flange that has an outer rim with a locking surface thereon, the flange is positioned proximate to the first end of the bearing for abutting the first side of the projection of the first jaw; and a bore extending through the bearing. The grapple assembly also includes a pin positioned in the bore of the bearing; a collar positioned on the second end of the bearing for abutting the first side of the projection of the second jaw such that the second sides of the first and second jaws are in face-to-face relation and the projections are located between the flange and the collar; and an element located on the first side of the projection of the first jaw, the element engages the locking surface of the outer rim of the flange for locking the bearing to the first jaw such that the bearing and the first jaw rotate together.

In another aspect, this disclosure describes a connecting and adapting system of components for interconnecting first and second opposed jaws of a grapple assembly and for adapting the grapple assembly for connecting to a plurality of linkages, each jaw of the grapple assembly has a connected end and a free end, each connected end includes a projection that has at least one aperture, the aperture of the first jaw is axially aligned with the aperture of the second jaw. The system includes a bearing that has a first end and a second end and a total length, the second end has first and second securing slots formed therein. The bearing comprises: an elongated section extending between the first and second ends of the bearing, the elongated section is sized for receipt in the aperture of each jaw for connecting the jaws together; a flange that has an outer rim with a locking surface thereon, the flange is positioned proximate to the first end of the bearing, the flange abuts the projection of the first jaw; and a bore extending through the bearing. The system also includes: a pin sized for insertion in the bore, the pin has a securing slot formed therein; a collar sized for receiving the second end of the bearing, the collar has first and second securing slots formed therein, the collar abuts the projection of the second jaw; a first dowel is sized for receipt in the first securing slot of the bearing, the securing slot of the pin, and the first securing slot of the collar, the first dowel interlocks the bearing, the pin, and the collar; and a second dowel is sized for receipt in the second securing slot of the collar and the second securing slot formed in the second end of the bearing, the second dowel interlocks the bearing and the collar.

In yet another aspect, this disclosure describes a method for interconnecting first and second opposed jaws of a grapple assembly and for adapting the grapple assembly for connecting to a plurality of linkages, each jaw of the grapple assembly has a connected end and a free end, each connected end includes a projection that has at least one aperture, the aperture of the first jaw is axially aligned with the aperture of the second jaw, and the projection of the first jaw has an element thereon. The method includes the step of positioning an elongated section of a bearing in the aperture of each jaw for connecting the jaws together. The bearing comprises: a first end and a second end; a flange that has a thickness and an outer rim, the outer rim has a locking surface thereon, the flange is positioned proximate to the first end of the bearing; and a bore extending through the bearing. The method further includes the steps of arranging the flange of the bearing for abutting the projection of the first jaw, arranging a collar for engaging the second end of the bearing and for abutting the projection of the second jaw, locking the securing surface of the flange to the element located on the projection of the first jaw such that the bearing and the first jaw rotate together, and positioning a pin in the bore of the bearing.

DETAILED DESCRIPTION

The disclosure relates to a system and method for interconnecting the jaws of a grapple assembly and adapting the grapple assembly for connecting to a multiplicity of linkages such as couplers being positioned on the arm of an excavator.

Figure 1:
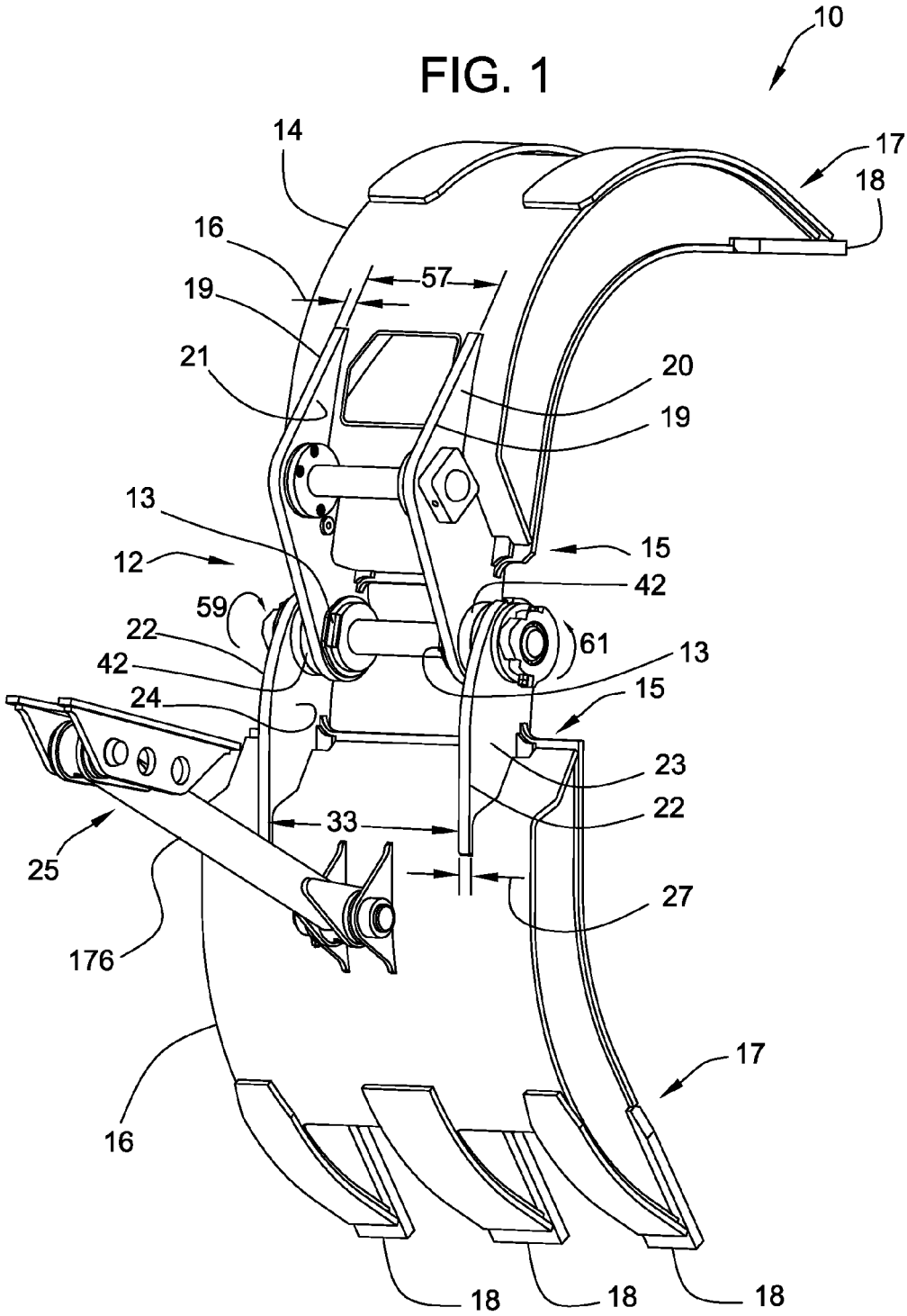
FIG. 1 is a perspective view of a grapple assembly including a system for connecting and adapting the grapple assembly.

Referring now the drawings, FIG. 1 is a perspective view of an embodiment of a grapple assembly 10 including a connecting and adapting system 12. The grapple assembly 10 may be, for example, connected to the arm of an excavator. It will be appreciated, however, that the grapple assembly 10 can be connected to machines other than excavators. In FIG. 1, the grapple assembly 10 is shown disconnected from, and independent of, an arm of an excavator. The grapple assembly 10 includes a pair of jaws 14, 16. Jaw 14 is referred to herein as the first jaw, and jaw 16 is referred to herein as the second jaw. It will be appreciated that the jaws 14, 16 are interchangeable and that jaw 14 can be the second jaw and jaw 16 can be the first jaw. It will also be appreciated that the grapple assembly 10 can include more than two jaws.

Each of the first and second jaws 14, 16 has a connected end 15 and a free end 17. The system 12 connects the connected end 15 of the first jaw 14 to the connected end 15 of the second jaw 16. The free ends 17 of the first and second jaws 14, 16 have tines 18 for gripping and handling objects and debris. The tines 18 of the first jaw 14 are in spaced relation to the tines 18 of the second jaw 16 such that, when the grapple assembly 10 closes, the tines 18 interlock, thereby creating an enclosure for securing objects and debris.

The first jaw 14 has projections 19, and the second jaw 16 has projections 22. Projections 19 have outer surfaces 20 and inner surfaces 21, where the outer and inner surfaces 20, 21 are separated by a distance 16. Accordingly, projections 19 have a width 16. Projections 22 have outer surfaces 23 and inner surfaces 24, where the outer and inner surfaces 23, 24 are separated by a distance 27. Accordingly, projections 22 have a width 27. It will be appreciated that the outer and inner surfaces 20, 21, 23, 24 can be interchangeably referred to as first and second surfaces.

The outer surfaces 20 of the projections 19 of the first jaw 14 are separated by a distance 57. And the inner surfaces 24 of the projections 22 of the second jaw 16 are separated by a distance 33. In the illustrated embodiment, the distance 57 between the outer surfaces 20 of the projections 19 of the first jaw 14 is less than the distance 33 between inner surfaces 24 of the projections 22 of the second jaw 16. Accordingly, when the first and second jaws 14, 16 are oppositely arranged, as shown in FIG. 1, the projections 19 of the first jaw 14 can be positioned between the projections 22 of the second jaw 16. As described in detail below, the system 12 interconnects projections 19 of the first jaw 14 and projections 22 of the second jaw 16.

Figure 4:
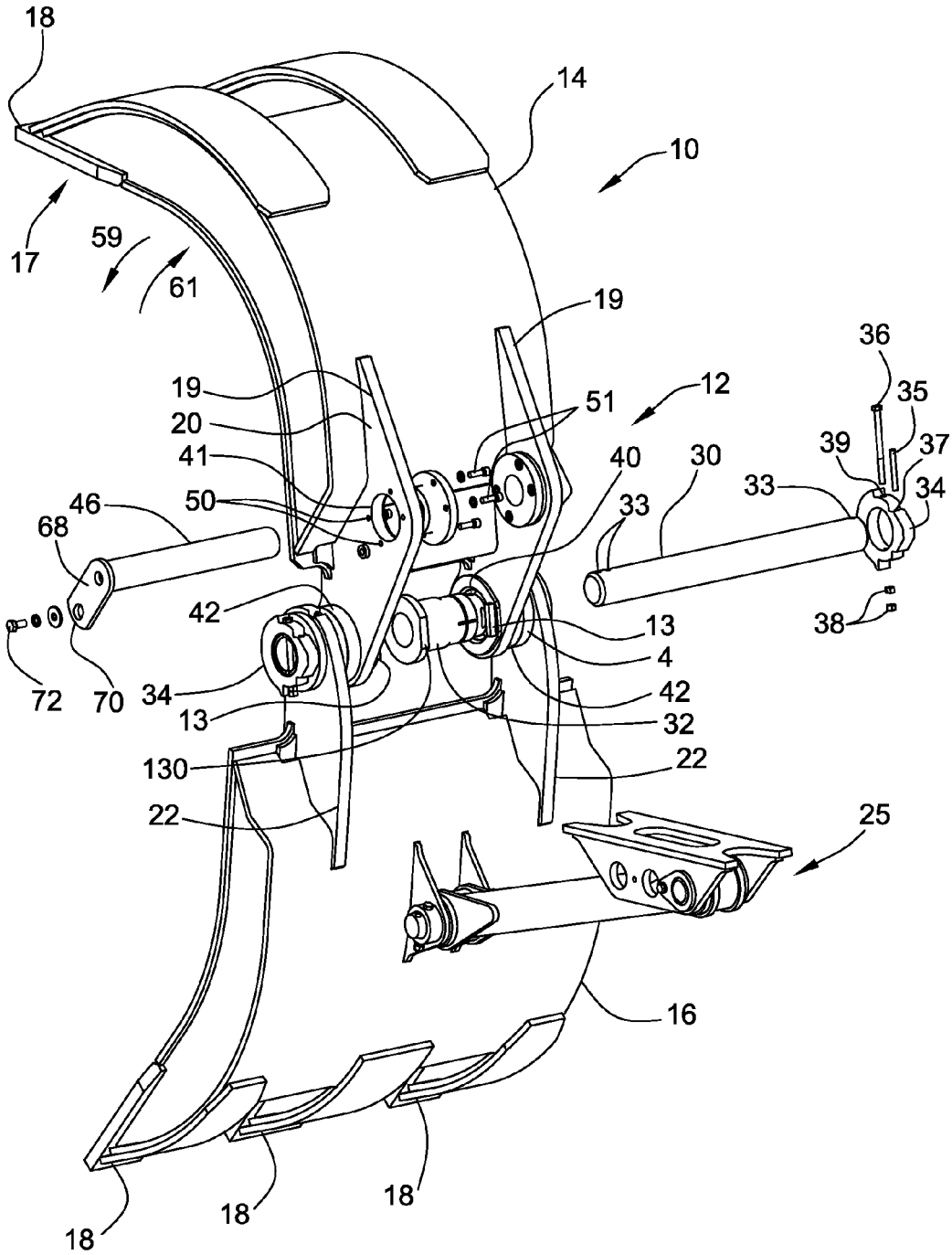
FIG. 4 is a perspective and partially exploded view of the grapple assembly of FIG. 1 including the system for connecting and adapting the grapple assembly.
Figure 5:
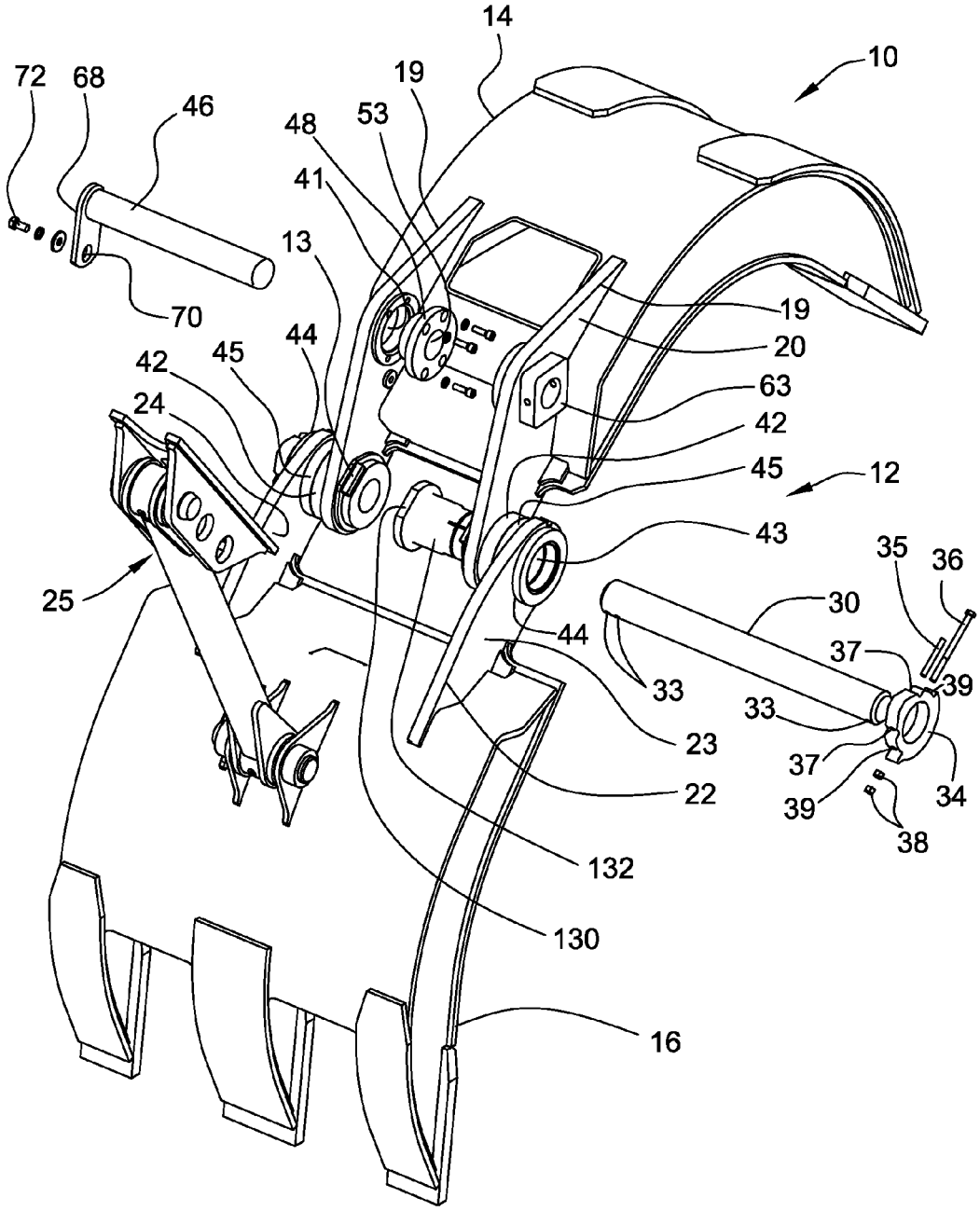
FIG. 5 is another perspective and partially exploded view of the grapple assembly of FIG. 1 including the system for connecting and adapting the grapple assembly of FIG. 2.

Referring to FIGS. 4 and 5, each is a perspective and partially exploded view of the grapple assembly 10 and includes the system for connecting and adapting 12, where the projections 19, 22 of the grapple assembly 10 are illustrated as being partially independent from the connecting and adapting assembly 12. Each projection 19 of the first jaw 14 includes a first aperture 40 and a second aperture 41. The outer surface 20 of each projection 19 includes a reinforcing rim 42, the reinforcing rim 42 being associated with the first aperture 40. Each projection 22 of the second jaw 16 includes an aperture 43. The outer surface 23 of each projection 22 includes a reinforcing rim 44, the reinforcing rim 44 being associated with the aperture 43. And, similarly, the inner surface 24 of each projection 22 includes a reinforcing rim 45, the reinforcing rim 45 being associated with the aperture 43. As described in detail below, the apertures 40, 41, 43 of the grapple assembly 10 receive portions of the system for connecting and adapting 12.

Referring again to FIG. 1, the first jaw 14 can include an element 13. In the embodiments described herein, the element 13 is a boss located on the inside surface 21 of each projection 19. As described in detail below, the boss 13 of the grapple assembly 10 interacts with a portion of the system 12. The second jaw 16 can include a linkage assembly 25 for linking it to the excavator. For example, the linkage assembly 25 can connect the second jaw 16 to an arm of an excavator. The linkage assembly 25 prevents the second jaw 16 from rotating, or otherwise moving, independently relative to the arm of the excavator.

Figure 2:
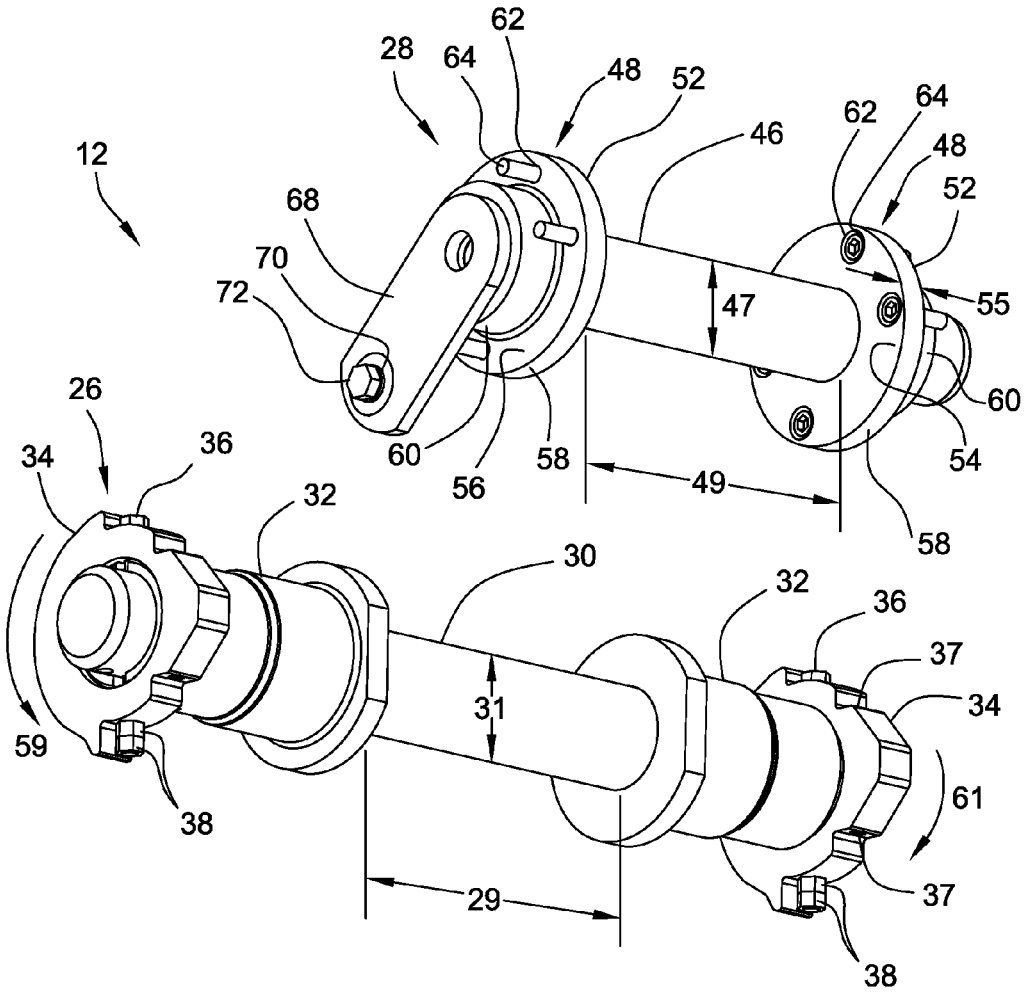
FIG. 2 is a perspective view of the connecting and adapting system usable in the grapple assembly of FIG. 1.

FIG. 2 is a perspective view of an embodiment of the connecting and adapting system 12. The system 12 can be used in the grapple assembly 10. For example, the system 12 can be used in the grapple assembly 10 for interconnecting the first and second jaws 14, 16. Also, for example, the system 12 can be used in the grapple assembly 10 for adapting the grapple assembly 10 for connecting to a multiplicity of linkages, where the linkages are located on the arm of an excavator. The system 12 includes, among other things, a first unit 26 and a second unit 28.

The first unit 26 of the system 12 includes a pin 30, bearings 32, and collars 34. The pin 30 has an outer diameter 31 sized to receive the bearings 32. Additionally, the outer diameter 31 of the pin 30 is sized for being received by a coupler positioned on an arm of the excavator. The pin 30 has a connecting location 29 that is also sized for being received by a coupler positioned on an arm of the excavator. The connecting location 29 is of a length that corresponds to a specific coupler and the outer diameter 31 is of a diameter that corresponds to the same coupler, where the coupler is positioned on the arm of the excavator. The outer diameter 31 and the connecting location 29 of the pin 30 are appropriately sized for operatively associating with the particular coupler positioned on the arm of the excavator.

The outer limits of the connecting location 29 of the pin 30 are defined by the bearings 32, where one bearing 32 as shown is located on one end of the pin 30 and another bearing 32 is located on the other end of that pin. The bearings 32 are oppositely arranged such that their corresponding parts are of equal distance from the respective ends of the pin 30. A collar 34 is located on each bearing 32 such that the collars 34 are positioned proximate to both an end of each bearing 32 and the respective ends of the pin 30. As described in more detail below, each of the pin 30, the bearings 32, and the collars 34 include securing slots for receiving a center dowel pin 36. Additionally, the collars 34 include a securing slot 37 that corresponds to a groove 110 located on the bearings 32. The dowel 36 can be a capscrew that passes through securing holes in the pin 30, the bearing 32, and the collar 34, the capscrew being secured on one end by fastening nuts 38. The center pins 36 interconnect the pin 30, the bearings 32, and the collars 34 such that all of the components of the first unit 26 move in synchronization. For example, if the pin 30 moves in either direction 59, 61, the bearings 32 and the collars 34 will correspondingly move in either direction 59, 61.

The second unit 28 of the system 12 includes a second pin 46, second bearings 48, and a securing bracket 68. The second pin 46 has an outer diameter 47 sized to receive the second bearings 48, and the outer diameter 47 is sized for being received by a coupler positioned on the arm of the excavator. The pin 46 also has a connecting location 49 sized for being received by a coupler positioned on the arm of the excavator. The connecting location 49 is of a length that corresponds to a particular coupler and the outer diameter 47 is of a diameter that corresponds to that same coupler, where the coupler is positioned on the arm of the excavator. The outer diameter 47 and the connecting location 49 of the second pin 46 are appropriately sized for operatively associating with the coupler positioned on the arm of the excavator.

The outer limits of the connecting location 49 of the second pin 46 are defined by the second bearings 48, where one of the second bearings 48 is located on one end of the second pin 46 and another one of the second bearings 48 is located on the other end of that pin. The second bearings 48 are oppositely arranged such that their corresponding parts are of equal distance from the respective ends of the second pin 46. The second bearings 48 each include a flange 52, and each flange 52 includes an inside surface 54, an outside surface 56, and an outer edge 58. The second bearings 48 also include an elongated section 60 extending away from the outside surface 56 of the flange 52.

Referring to FIGS. 2, 4, and 5, the second unit 28 includes several mechanisms that secure it to the first jaw 14. For example, the second bearing 52 includes a plurality of securing slots 62 sized to receive a corresponding number of securing pins 64. The securing slots 62 and securing pins 64 combine to connect the second bearings 52 to the projections 19 of the first jaw 14. Also shown, the inside surface 54 of the flange 52 of the second bearing 48 can be face to face with the inside surface 21 of the projection 19 of the first jaw 14, where the elongated section 60 of the second bearing 48 extends through the aperture 41. Further, the securing slots 62 of the second bearing 48 are aligned with a plurality of slots 50 formed in the projection 19, and securing pins 51 pass through the slots 62, 50 for securing the second bearing 48 to the first jaw 14.

Another mechanism for securing the second unit 28 to the first jaw 14 is a securing bracket 68 that is connected to an end of the second pin 46. The securing bracket 68 includes a securing slot 70 and a securing pin 72, wherein securing pin 72 passes through the securing slot 70 for connection to one of the projections 19 of the first jaw 14. Accordingly, the securing slots and pins 62, 64 combined with the securing bracket, slot, and pin 68, 70, 72 prevent the second unit 28 from moving independently of the first jaw 14.

Figure 3:
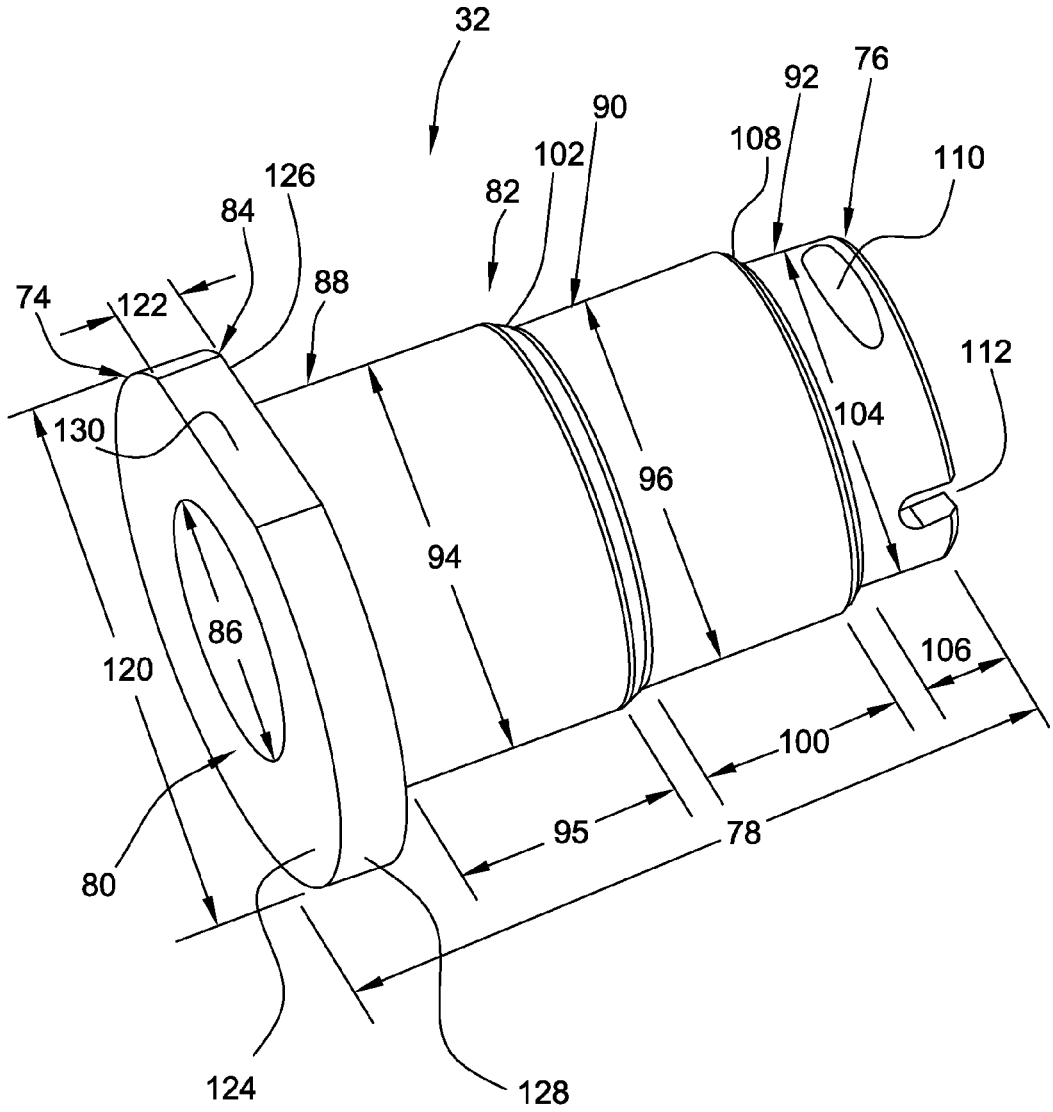
FIG. 3 is a bearing usable in the connecting and adapting system of FIG. 2.

FIG. 3 is a perspective view of an embodiment of a bearing 32 of the first unit 26, the bearing 32 having first and second ends 74, 76 and a total length 78. When the connecting and adapting assembly 12 is used in the grapple assembly 10, as illustrated in FIGS. 1, 4, and 5, bearings 32 are positioned in the apertures 40, 43, which are respectively formed in the projections 19, 22 of the first and second jaws 14, 16. The bearings 32 are positioned in the apertures 40, 43 of the projections 19, 22 such that the first ends 74 of the bearings 32 are positioned proximate to the inside surfaces 21 of the projections 19 of the first jaw 14 and the second ends 76 of the bearings 32 are positioned proximate to the outside surfaces 23 of the projections 22 of the second jaw 16.

The exemplary bearing 32 of FIG. 3 includes a bore 80, an elongated section 82, and a flange 84. The bore 80 has an inner diameter 86 and extends the total length 78 of the bearing 32 from its first end 74 to its second end 76. The inner diameter 86 of the bearing 32 is sized for loosely receiving pin 30. The inner diameter 86 of the bore 80 remains constant throughout the total length 78 of the bearing 32.

Referring to FIGS. 3, 4 and 5, the elongated section 82 of the exemplary bearing 32 includes a first portion 88, a second portion 90, and a third portion 92. The first portion 88 has an outer diameter 94. The outer diameter 94 of the first portion 88 is sized for being received by the apertures 40 formed in the projections 19 of the first jaw 14. The first portion 88 has a length 95, where the length 95 corresponds substantially to the width of the apertures 40 formed in, including the width of the reinforcing rims 44, 45 formed on, the projections 19 of the first jaw 14.

The second portion 90 of exemplary bearing 32 has an outer diameter 96 that is sized for being received by the apertures 43 formed in the projections 22 of the second jaw 16. The second portion 90 has a length 100, where the length 100 corresponds substantially to the width of the apertures 43 formed in, including the width of the reinforcing rims 44, 45 formed on, the projections 22 of the second jaw 16.

An inclined surface 102 is positioned between the first and second portions 88, 90 of the elongated section 82 of the bearing 32. When the connecting and adapting assembly 12 is used in the grapple assembly 10 to, among other things, connect the first jaw 14 to the second jaw 16, as illustrated in FIG. 1, the inclined surface 102 provides spacing between the projections 19 of the first jaw 14 and the projections 22 of the second jaw 16. Because the first portion 88 of the bearing 32 is substantially positioned in the apertures 40 of the projections 19 of the first jaw 14, and the second portion 90 of the bearing 32 is substantially positioned in the apertures 43 of the projections 22 of the second jaw 16, the inclined surface 102, which is positioned between the first and second portions 88, 90, effectively separates the reinforcing rims 42 from the reinforcing rims 45. Accordingly, for example, when the first jaw 14 moves in either direction 59, 61 relative to the second jaw 16, no resistance forces result from friction between the reinforcing rims 42 of the first jaw 14 and the reinforcing rims 45 of the second jaw 16.

The third portion 92 of exemplary bearing 32 has an outer diameter 104 that is sized for being received by the collar 34, and the outer diameter 104 can be sized such that it is too small for being securely received by the apertures 43 formed in the projections 22 of the second jaw 16. The third portion 92 has a length 106, where the length 106 is sized for substantially corresponding with the width of the collar 34.

An inclined surface 108 is positioned between the second and third portions 90, 92 of the elongated section 82 of the bearing 32. When the connecting and adapting assembly 12 is used in the grapple assembly 10, as illustrated in FIG. 1, the inclined surface 108 provides spacing between the reinforcing rim 44 of the second jaw 16 and the collar 34. Because the second portion 90 of the bearing 32 is substantially positioned in the aperture 43 of the projection 22 of the second jaw 16 and the third portion 92 of the bearing 32 is substantially positioned in the collar 34, the inclined surface 108, which is positioned between the second and third portions 90, 92 effectively separates the reinforcing rim 44 of the second jaw 16 from the collar 34. Accordingly, for example, when the collar 34 moves with the first jaw 14, in either direction 59, 61, relative to the second jaw 16, no resistance forces result from friction between the reinforcing rim 44 of the second jaw 16 and the moving collar 34.

Referring now to the flange 84 of the bearing 32, the flange 84 has an outer diameter 120 and a thickness 122. The flange 32 also has an outer surface 124 and an inner surface 126. The flange 84 includes an outer rim 128 being positioned between, and substantially perpendicular to, the inner and outer surfaces 124, 126. Referring to FIG. 2, the thickness 122 of the flanges 84 is inversely proportional to the length of the connecting location 29. As the thickness 122 of the flanges 84 increases, the length of the connecting location 29 decreases. And as the thickness 122 of the flanges 84 decreases, the length of the connecting location 29 increases. Likewise, referring to the second unit 28 of the system 12, the thickness of the second flanges 48 of the second bearings 52 is inversely proportional to the length of the connecting location 49. Accordingly, the thicknesses of the respective flanges 48, 84 can be adjusted to provide suitably sized connecting locations 29, 49 for connecting the system 12 to a coupler or linkage mounted on the arm of an excavator.

A locking portion 130 is formed in the outer rim 128 of the flange 32 for engaging the bosses 13 located on the projections 19 of the first jaw 14. Referring to FIGS. 1, 4, and 5, when the system 12 is used in the grapple assembly 10, the bosses 13 provided on the inside surfaces 21 of the projections 19 of the first jaw 14 engage the locking portions 130 of the bearings 32. This engagement links the rotation of the first unit 26 of the system 12 to the rotation of the first jaw 14. For example, when the first jaw 14 moves in either direction 59, 61, the engagement between the locking portion 130 of bearings 32 and bosses 13 of the jaw 14 causes the bearings 32 to correspondingly move in either direction 59, 61. Other components, e.g., the pin 30 and the collars 34, of the first unit 26 correspondingly move with the first jaw 14, in either direction 59, 61, because of their interconnection with the correspondingly moving bearings 32. This interconnection among the components of the first unit 26 will now be described.

As previously mentioned with reference to FIG. 2, each of the pin 30, the bearings 32, and the collars 34 include securing slots for receiving securing pins. These securing slots and pins combine to interlock the respective components of the first portion 26 of the system 12. It follows that these interlocked components, e.g., the pin 30, the bearings 32, and the collars 34, of the first portion 26 interface with components, e.g., the projections 19, 22 of the first and second jaws 14, 16 so as to interconnect the jaws 14, 16 and to secure the system 12 within the grapple assembly 10. For example, the elongated sections 82 of the bearings 32 are positionable in the apertures 40, 43 of the projections 19, 22 so as to interconnect the first and second jaw 14, 16, and the locking portions 130 of the flanges 84 of the bearings 32 are interlockable with bosses 13 of the projections 19, 22 so as to synchronize the movement, in either direction 59, 61, of the upper jaw 14 of the grapple assembly 10 and the first unit 26, including the pin 30, of the system 12.

Because the pin 30 is movable independent of the second jaw 16 and because the pin 30 moves in synchronization with the first jaw 14, the system 12 is well suited for connecting the grapple assembly 10 to a quick coupler, the quick coupler being located on the arm of an excavator. This is because quick couplers are configured for connecting the grapple assembly 10 to the excavator by quickly grabbing the first and second pins 30, 46 of the system 12. This connection between the quick coupler and the pins 30, 46 is one in which the pins cannot move independent of the quick coupler. In other words, the pins 30, 46 cannot rotate, or otherwise move, independent of the quick coupler. To open and close the grapple assembly 10, the quick coupler will rotate in either direction 59, 61 relative to the arm of the excavator, thereby moving the first and second pins 30, 46 in direction 59, 61. Moreover, and despite the lower jaw 16 being fixed to the arm of the excavator, the quick coupler as disclosed can effectively open and close the grapple assembly 10 because the first pin 30 is free to rotate, independent of the lower jaw 16, in synchronization with the moving quick coupler.

Examples of the securing slots formed in the first unit 26 of the system 12 are illustrated in FIGS. 3-5. The pin 30, as illustrated in FIGS. 4 and 5, has a plurality of securing slots 33 formed in its respective ends. The bearings 32, as illustrated in FIG. 3, has a securing groove 110 and securing slots 112 formed in its third portion 92. And the collar 34, as illustrated in FIGS. 4 and 5, has securing slots 37, 39. Slots 33 of the pin 30, slots 112 of the bearing 32, and slots 39 of the collar 34 can be aligned for receiving the center dowel pin 36, thereby interconnecting the components of the first unit 26. Accordingly, the components of the first unit 26 unitarily move as a single unit. For example, if the pin 30 moves in either direction 59, 61, the bearings 32 and the collar 34 will correspondingly move in either direction. Additionally, the securing groove 110 of the bearing 32 and the securing slot 37 of the collar 34 can be aligned for receiving the roll pin 35.

These interlocked components of the first portion 26 interface with components of the first and second jaws 14, 16 so as to interconnect the jaws 14, 16 and to secure the system 12 within the grapple assembly 10. For example, bearings 32 are positioned in the apertures 40, 43 of the projections 19, 22 of the first and second jaws 14, 16, thereby connecting the first and second jaws. The inside surfaces 126 of the flanges 84 of the bearings 32 abut the inside surfaces 24 of the projections 19 of the first jaw 14 and, in a similar manner, the collars 34 abut the outside surfaces 23 of the projections 22 of the second jaw 16. It follows that, because the pin 30, the bearings 32, and the collars 34 of the first portion 26 are interlocked, the abutting flange 84 of bearings 32 and abutting collars 34 collectively secure the first portion 26 of the connecting and securing system 12 within the grapple assembly 10.

The pin 30 can be removed from the first portion 26 of the connecting and securing system 12 without disconnecting the first and second jaw 14, 16. This feature is facilitated by the securing grooves 110 of the bearings 32 and the securing slots 37 of the collars, combined with the roll dowel pins 35. The roll dowel pins 35 do not secure the pin 30. Accordingly, when the center dowels 36 are removed, thereby permitting removal of the pin 30, the roll dowel pins 35 can remain in the securing slots 37 and grooves 110 for interconnecting the bearings 32 and the collars 34, thereby maintaining the connection between the first and second jaws 14, 16. In other words, the roll dowels 35 can be inserted into the securing slots 37 of the collars 34 and the securing grooves 110 of the bearings 32, thereby interlocking the bearings 32, the collars 34, and the projections 19, 22 of the jaws 14, 16, while leaving the pin 30 free to move independent of the interlocked bearings 32, collars 34 and jaws 14, 16.

The first and second units 26, 28 of the system 12 can include pins 30, 46, bearings 32, 48, and collars 34 of different sizes, thereby providing multiple sizes of pin diameters 31, 47 and connecting locations 29, 49 for connecting the grapple assembly 10 to multiple sizes and types of linkages, e.g., couplers, where the linkages connect the grapple assembly 10 to the arm of the excavator. For example, if a coupler located on the arm of an excavator is connectable only to a pin 30 having a specific pin diameter 31 and connection location 29, the system 12 can be, for example, adapted to include bearings 32 having an appropriate flange thickness 122 to provide the specified connecting location 29, and the bearings can have a bore 80 having an appropriate inner diameter 86 for receiving the pin 30 having the specific out diameter 31. The system 12 can be further adapted to include a pin 30 having the appropriate outer diameter 31 for connecting to the coupler, and the pin 30 can be positioned in the adapted bore 80. Additionally, the system 12 can be adapted to include collars 34 sized for fitting around the third portion 92 of the adapted bearings 32. Exemplary methods for adapting the system 12 are described in detail below.

Figure 6:
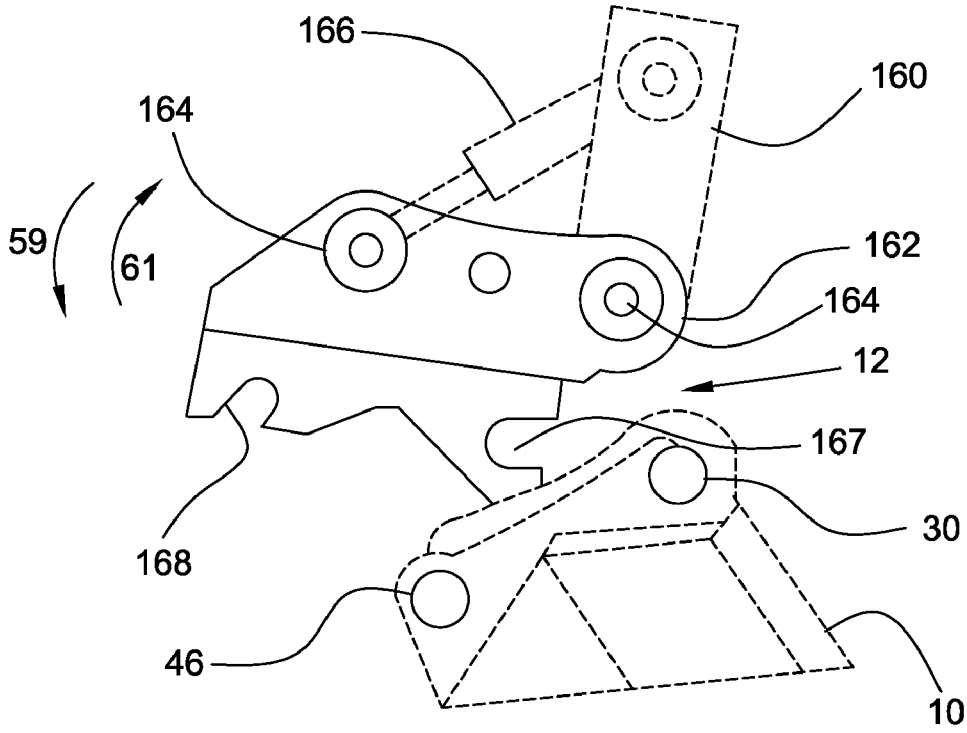
FIG. 6 is a side view of an exemplary linkage for connecting an arm of an excavator to the system for connecting and adapting the grapple assembly of FIG. 2.
Figure 7:
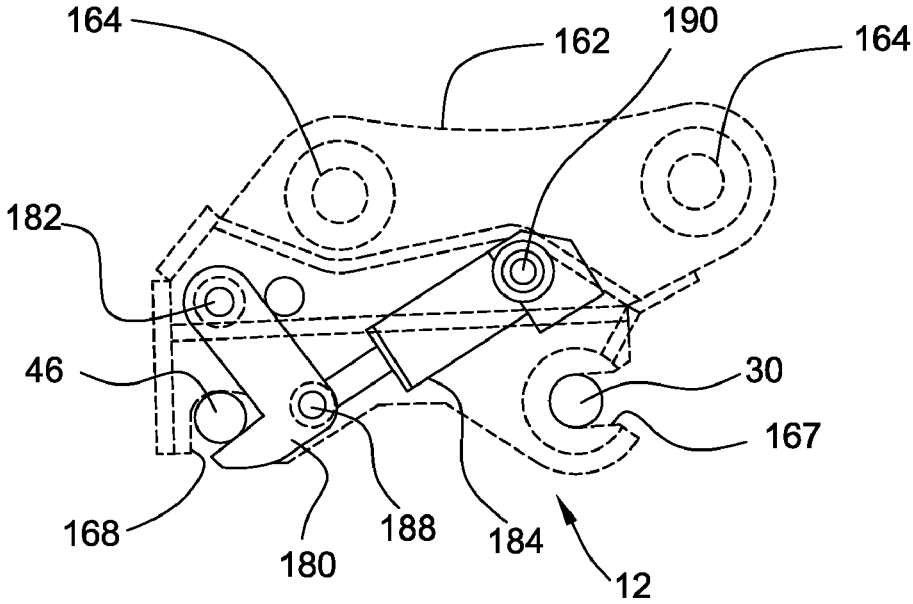
FIG. 7 is a side view of an exemplary linkage for connecting an arm of an excavator to the system for connecting and adapting the grapple assembly of FIG. 2.

FIG. 6 illustrates a portion of an embodiment of the grapple assembly 10, where an embodiment of the connecting and adapting system 12 connects the grapple assembly 10 to an arm 160 of an excavator via a linkage 162. FIG. 7 illustrates exemplary linkage 162 for connecting an arm of an excavator to the system 12 for connecting and adapting the grapple assembly 10. The exemplary linkage illustrated in FIG. 7 is quick coupler 162. The coupler 162 is rotatably connected to the arm 160 at joint 164, where an appropriately sized pin 165 passes through the coupler 162 and the arm 160 for securing the coupler 162 to the arm 160. A piston and cylinder device 166 is connected to the arm 160 and the coupler 162 for controlling the coupler 162. For example, the piston and cylinder device 166 can move the coupler 162 in directions 59, 61 relative to the arm 160. When the grapple assembly 10 is connected to the coupler 162, the piston and cylinder device 166 at least partially controls the grapple assembly 10.

The exemplary coupler 162 of FIG. 6 facilitates a quick connection of the grapple assembly 10, by way of the system 12, to the arm 160. As illustrated, the coupler 162 includes a first hook-like aperture 167 and a second opening recess 168. For connecting the grapple assembly 10 to the arm 160, the excavator operator maneuvers the arm 160 to the position shown in FIG. 6 and then moves the arm 160 downwardly so as to engage the hook-like aperture 167 with the pin 30 of the system 12. The operator then actuates the piston and cylinder device 166 so as to move the second recess 168 into engagement with the second pin 46 of the system 12. Next, the coupler 162 can be latched in position with latching hook(s) so that the first hook-like aperture 167 and/or the second opening recess 168 are clamped around the respective pins 30, 46.

An example of this latching hook is shown in FIG. 7 as latching hook 180. The latching hook 180 is shown grabbing the second pin 46. It will be appreciated that the latching hook 180 can be used to grab either, or both, pins 30, 46. The hook 180 can be pivotally supported on the body of the coupler 162 about a pivot 182 and biased to a latching position by means of a second piston and cylinder device 184, which can also be used to move the hook 180 to a release position. The piston of the device 184 is pivotally connected to the hook 180 at 188 and the cylinder is pivotally connected to the body of the coupler at 190. In the illustrated embodiment, the latching hook 180 maintains the pin 46 in the recess 168 and, although not illustrated, it will be appreciated that a second hook 180 can maintain the pin 30 in the hook-like aperture 167.

Figure 8:
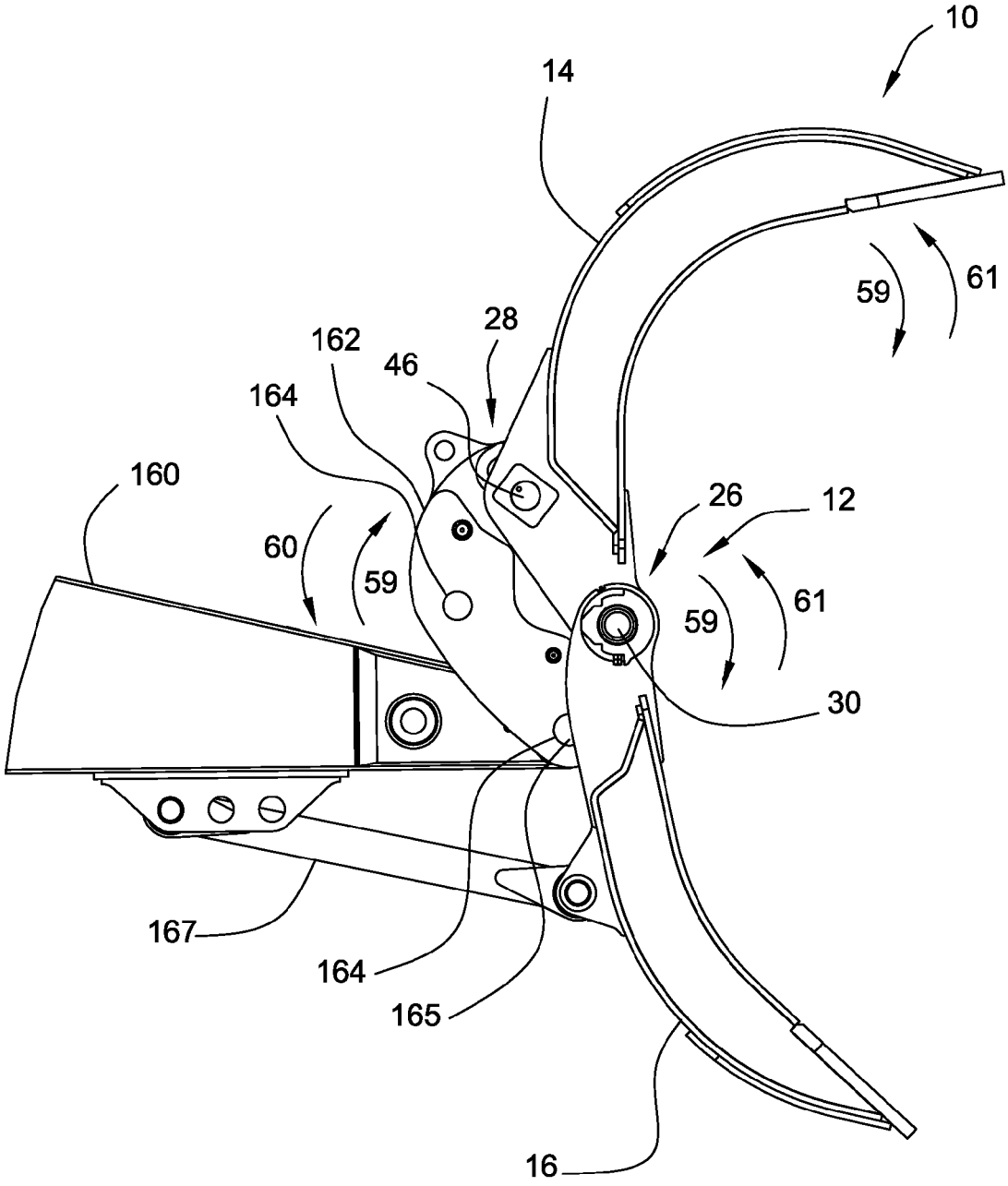
FIG. 8 is a side view of the grapple assembly of FIG. 1 including the system for connecting and adapting the grapple assembly of FIG. 2 being connected to an arm of an excavator.
Figure 9:
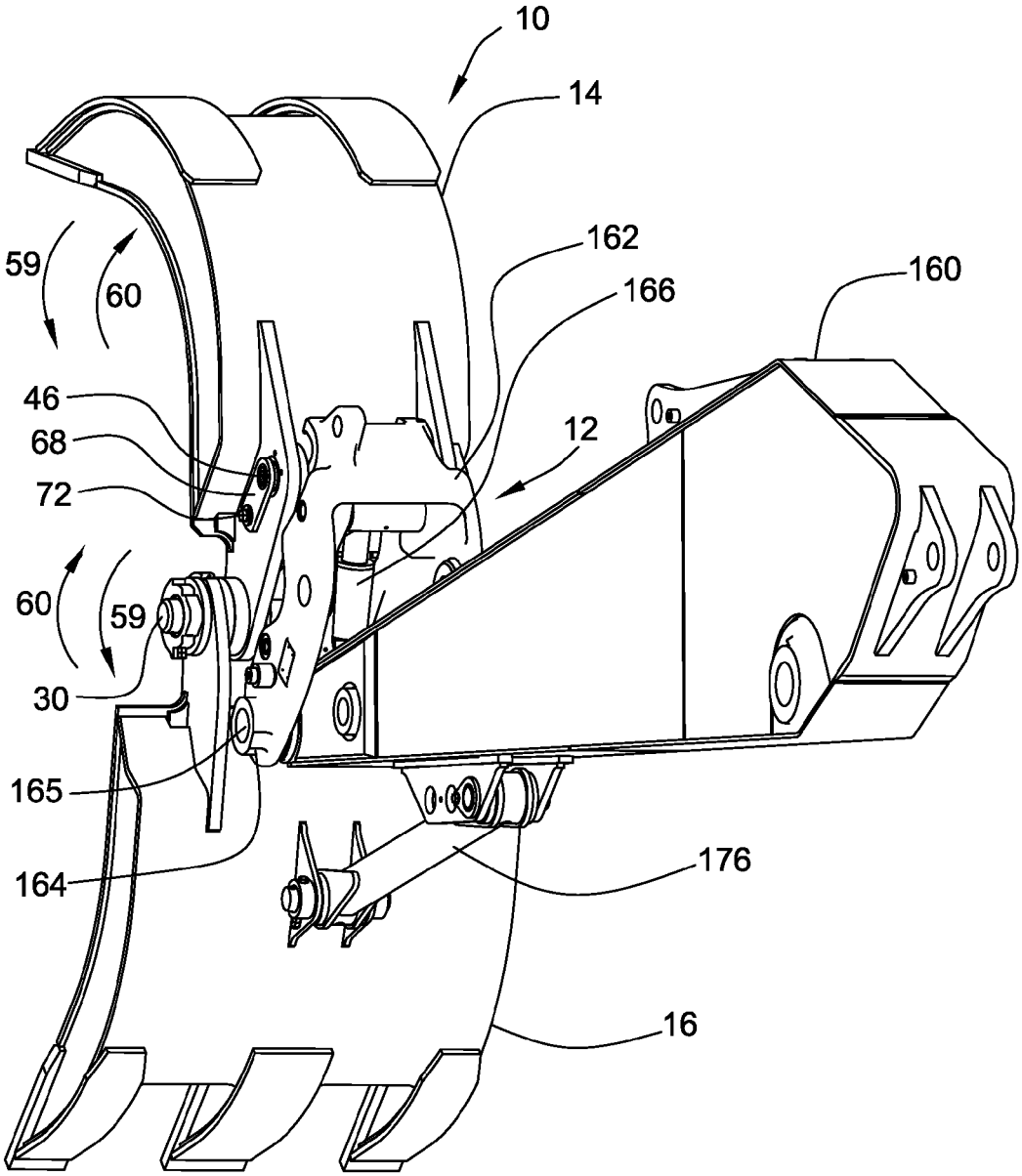
FIG. 9 is a rear perspective view of the grapple assembly of FIG. 1 including the system for connecting and adapting the grapple assembly of FIG. 2 being connected to the arm of an excavator.

Referring now to FIGS. 8 and 9, where an embodiment of the system 12 is shown connecting an embodiment of the grapple assembly 10 to an arm 160 of an excavator, the coupler 162 is rotatably connected to the arm 160 at joint 164, where an appropriately sized pin 165 passes through the coupler 162 and the arm 160 for securing the coupler 162 to the arm 160. A piston and cylinder device 166 is connected to the arm 160 and the coupler 162 for moving the coupler 162 in directions 59, 61 relative to the arm 160. Also shown is a stiff arm 176 for connecting the second jaw 16 of the grapple assembly 10 to the arm 160. Because the second jaw 16 cannot move relative to the arm 160, the first jaw 14 moves, in directions 59, 61, toward and away from static second jaw 16 for opening and closing the grapple assembly 10. For example, when the grapple assembly 10 moves between open and closed positions, the first jaw 14 moves in directions 59, 61, while the second jaw 16 remains stationary.

The embodiment of the connecting and adapting system 12 shown in FIGS. 8 and 9 includes appropriately sized pins 30, 46 for connecting the coupler 162 to the grapple assembly 10. For example, diameters 31, 47 and connecting locations 29, 49 of the pins 30, 46 are sized for being received by the coupler 162. It will be appreciated that the coupler 162 shown in FIGS. 8 and 9 is fixedly connected to the pin 30 of the system 12 such that the pin 30 cannot move independent of the coupler 162. For example, the pin 30 cannot rotate independent of, or inside of, the coupler 162. It should also be appreciated that the coupler 162 connects to both the pin 30 and the second pin 46 in a manner that does not allow the either pin 30 or the second pin 46 to rotate independent of the coupler 162.

To move the jaws 14, 16 of the grapple assembly 10 from the open position, as illustrated in FIGS. 8 and 9, to a closed position, the operator of the excavator would actuate the piston and cylinder device 166 to move the coupler 162 in the direction 59. Similarly, to move the jaws 14, 16 of the grapple assembly 10 from the closed position to the open position, the operator would actuate the piston and cylinder device 166 to move the coupler 162 in the direction 61. Because the coupler 162 is connected to pins 30, 46, movement of the coupler 162 in either direction 59, 61 would cause the first jaw 14 to correspondingly move in either direction 59, 61. But, because the stiff arm 176 prevents the second jaw 16 from moving in either direction 59, 61, the second jaw 16 does not move when the operator actuates the piston and cylinder device 166 to move the connector 162 in either direction 59, 61. Accordingly, the first jaw 14 moves, while the second jaw 16 remains fixed.

Referring to FIGS. 1-5 and 8-9, because of the previously described relationship between the bosses 13 of the moving first jaw 14 and the locking portion 130 of the bearings 32, and because the bearings 32 are connected to the pin 30, the pin 30 moves in a manner that corresponds to the movement of the first jaw 14. It is important that the pin 30 be free to move independent of the fixed second jaw 16. Otherwise, a pin 30 that is retained in the second jaw 16 and unable to move independent of the jaw 16, upon movement of the first jaw 14, would rotate within the coupler 162, thereby causing the coupler 162 to disconnect from the pin 30. In addition to the pin 30 moving independent of the fixed second jaw 16, due to its interconnected components, the entire first unit 26 of the system 12 moves independent of the second jaw 16. Accordingly, when the piston and cylinder device 166 moves the coupler 162 in either direction 59, 61, the upper jaw 14 of the grapple assembly 10 and entire first unit 26, which includes the pin 30, the bearings 32, and the collar 34, of the system 12 correspondingly moves in either direction 59, 61.

Exemplary methods will be now be described for using the system 12. The system 12 can be used for: adapting grapple assemblies for connecting to a multiplicity of linkages, e.g., couplers positioned on the arm of an excavator; interconnecting the jaws of grapple assemblies; and connecting grapple assemblies to linkages of different types and sizes. For convenience, the following exemplary methods describe using the system 12 to adapt the grapple assembly 10 for connecting to the coupler 162 of FIGS. 6 and 7, to interconnect the jaws 14, 16 of the grapple assembly 10, and to connect the grapple assembly 10 to the coupler 162. It will be appreciated that the following exemplary methods are applicable for using the system 12 to adapt grapple assemblies other than the grapple assembly 10, to interconnect jaws of grapple assemblies other than the grapple assembly 10, and to connect grapple assemblies other than the grapple assembly 10 to linkages or couplers other than the coupler 162.

Using the system 12 for adapting the grapple assembly 10 for connecting to the coupler 162 includes the step of providing the system 12 with appropriately sized first and second units 26, 28. This includes, among other things, providing appropriately sized pins 30, 46, bearings 32, 48, collars 34, and hardware such as the bracket 68 and securing pins 35, 36, 64, 72. The respective pins 30, 46 of each unit 26, 28 should be sized for being received by the coupler 162. The respective bearings 32, 48 of each unit 26, 28 should be sized for being received by the apertures 40, 43 of the grapple assembly 10. Additionally, the bores 86, 53 of the bearings 32, 48 should be sized for receiving the respective pins 30, 46. Related methods are described in detail below.

Using the system 12 for adapting the grapple assembly 10 for connecting to the coupler 162 includes the step of providing an appropriately sized pin 30. The pin 30 of the system 12 should be sized to be received by the opening of the first hook-like aperture 167 of the coupler 162. Additionally, the pin 30 should be sized for extending across the distance between outer surfaces 23 of the projections 22 of the second jaw 16. This distance should include any distance associated with the reinforcing rings 44 and collars 34. Based on these determinations regarding the size of the opening of the first hook-like aperture 167 and the distance between outer surfaces 23 of the projections 22, the system 12 should be adapted by providing a pin 30 having a diameter 31 that corresponds to the size of the opening of the first hook-like aperture 167 and a length that corresponds to the distance between outer surfaces 23 of the projections 22 of the second jaw 16, including any distance added by the reinforcing rings 44 and the collars 34. It should be appreciated that the length of the provided pin 30 can marginally exceed the distance between outer surfaces 23 of the projections 22 of the second jaw 16, including any distance added by the reinforcing rings 44 and the collars 34.

Using the system 12 for adapting the grapple assembly 10 for connecting to the coupler 162 can also include the step of providing an appropriately sized second pin 46. The second pin 46 of the system 12 should be sized for being received by the opening of the second opening recess 168 of the coupler 162. Additionally, the second pin 46 should be sized for extending across the distance between outer surfaces 20 of the projections 19 of the first jaw 14. This distance should include any distance associated with reinforcing mount 63. Based on these determinations regarding the size of the opening of the second opening recess 168 and the distance between outer surfaces 20 of the projections 19 of the first jaw 14, the system 12 should be adapted by providing a second pin 46 having a diameter 47 that corresponds to the size of the opening of the second opening recess 168 and a length that corresponds to the distance between outer surfaces 20 of the projections 19 of the first jaw 14, including any distance added by the reinforcing mount 63. It should be appreciated that the length of the provided second pin 46 can marginally exceed the distance between outer surfaces 20 of the projections 19 of the first jaw 14, including any distance added by the reinforcing mount 63.

Using the system 12 to adapt the grapple assembly 10 for connecting to the coupler 162 can also include the step of providing appropriately sized bearings 32. The bearings 32 of the system 12 should be sized for being received by: apertures 40 of the projections 19 of the first jaw 14; apertures 43 of the projections 22 of the second jaw 16; and the collars 34. Additionally, the bearings 32 should be sized for receiving the pin 30. To size the bearings 32 for being received by the apertures 40, 43 and the collars 34, the diameters of the respective apertures 40, 43 and collars 34 should be determined. Based on that information, the system 12 can be adapted by providing bearings 32, where: the diameter 94 of the first portion 88 of the elongated section 82 of the bearings 32 is sized for being received by the apertures 40 of the projections 19; the diameter 96 of the second portion 88 of the elongated section 82 of the bearings 32 is sized for being received by the apertures 43 of the projections 22; and the diameter 104 of the third portion 92 of the elongated section 82 of the bearings 32 should be sized for being received by the collar 34. Additionally, the inner diameter 86 of the bore 80 of the bearings 32 is sized for receiving the outer diameter 31 of the pin 30.

Moreover, the step of providing appropriately sized bearings 32 includes providing bearings 32 having appropriately sized flange thicknesses 122. The thickness 122 of the flanges 84 determines the length of the connecting location 29. More particularly, the thickness 122 of the flanges 84 is indirectly proportional to the length of the connecting location 29, i.e., as the thickness 122 of the flanges 84 increases, the length of the connecting location 29 decreases, and as the thickness 122 of the flanges 84 decreases, the length of the connecting location 29 increases. Accordingly, the flange thicknesses 122 should be sized to provide an appropriate length of the connecting location 29, where an appropriate length of the connecting location 29 is a length sized for accommodating the coupler 162. That is, the connecting location 29 should be sized for receiving the horizontal length across the coupler 162. More particularly, the connecting location 29 should be sized for receiving the length across the first hook-like aperture 167. For example, the system 12 should be adapted by providing bearings 32 having a flange thickness 122, where the flange thickness 122 is approximately equal to the distance between the inner surfaces 21 of the projections 19 (including any distance added by reinforcement rings) minus the length across the first hook-like aperture 167 divided by two.

Using the system 12 to adapt the grapple assembly 10 for connecting to the coupler 162 can also include the step of providing appropriately sized second bearings 48. The second bearings 48 of the system 12 should be sized for being received by the apertures 41 of the projections 19 of the first jaw 14, and the second bearings 48 should be sized for receiving the second pin 46. To size the bearings 32 for being received by the apertures 41 of the projections 19 of the first jaw 14, the diameter of the apertures 41 should be determined. Based on that information, the diameter of the elongated section 60 should be sized for being received by the apertures 41. Additionally, the inner diameter of the bore 53 of the second bearings 48 should be sized for receiving the outer diameter 47 of the second pin 46.

Moreover, the step of providing appropriately sized second bearings 48 includes providing second bearings 48 having appropriately sized flange thicknesses 55. The thickness 55 of the flanges 52 determines the length of the connecting location 49. More particularly, the thickness 55 of the flanges 52 is indirectly proportional to the length of the connecting location 49, i.e., as the thickness 55 of the flanges 52 increases, the length of the connecting location 49 decreases; and as the thickness 55 of the flanges 52 decreases, the length of the connecting location 49 increases. Accordingly, the flange thicknesses 55 should be sized to provide a connecting location 49 having an appropriate length, where the appropriate length is a length sized for accommodating the coupler 162. That is, the connecting location 49 should be sized for receiving the length across the coupler 162. More particularly, the connecting location 49 should be sized for receiving the length across the second opening recess 168. For example, the system 12 should be adapted by providing bearings 48 having a flange thickness 55, where the flange thickness 55 is approximately equal to the distance between the inner surfaces 21 of the projections 19 (including any distance added by reinforcement rings) minus the length across the second opening recess 168 divided by two.

Using the system 12 to adapt the grapple assembly 10 for connecting to the coupler 162 can also include the step of providing appropriately sized collars 34. The collars 34 of the system 12 should be sized for receiving the third portion 92 of the elongated section 82 of the bearings 32. Based on the diameter 104 of the third portion 92, the system 12 should be adapted by providing a collar 34 having an inner diameter that corresponds to the diameter 104 of third portion 92 of the bearings 32. It should be appreciated that the inner diameter of the collar 34 can marginally exceed the diameter 104 of third portion 92 of the bearings 32. As previously disclosed herein, it should also be appreciated that the system 12 can be adapted by providing bearings 32 having a third portion 92, where the diameter 104 of the third portion 92 is sized for being received by the inner diameter of the collar 34.

Using the system 12 for interconnecting the jaws 14, 16 of the grapple assembly 10 includes, among others, the steps of: positioning the first and second jaws 14, 16 such that the apertures 40, 43 are axially aligned; positioning the bearings 32 in the apertures 40, 43; and positioning the collars 34 on the bearings 32. These steps will now be described in more detail.

The step of positioning the first and second jaws 14, 16 such that the apertures 40, 43 are axially aligned includes arranging the first and second jaws 14, 16 in an opposing relationship, as illustrated in FIGS. 1, 4, and 5. For example, end 15 of the first jaw 14 can be positioned proximate to end 15 of the second jaw 16, while end 17 of the first jaw 14 can be positioned remote from end 17 of the second jaw 16.

As shown in FIGS. 4 and 5, the step of positioning the bearings 32 in the apertures 40, 43 can include positioning the third portion 92 of the bearings 32 proximate to aperture 40 on the inside surface 21 of the projections 19. Then inserting the bearings 32 in the apertures 40, 43 such that the second portion 90 of the bearing 32 is positioned inside aperture 43, the third portion 90 of the bearing 32 is positioned inside aperture 40, and the inside surface 126 of the flange 84 abuts the inside surface 21 of the projection 19.

The step of positioning the collar 34 on the bearing 32 includes positioning the collar 34 around the third portion 92 of the bearing 32. This step further includes aligning the securing slots 37 of the collar with the securing groove 110 of the third portion 92 of the bearing 32 and positioning the collar 34 such that it abuts the outside surface 23 of the projection 22 of the second jaw 16. Next, the roll dowel 35 is positioned in the securing slots 37 and the groove 110, thereby securing the collar 34 onto the bearing 32 while not disturbing the integrity of the bore 80. Accordingly, the first and second jaws 14, 16 are interconnected, and the bores 86 are free to receive the pin 30.

Using the system 12 for connecting the grapple assembly 10 to the coupler 162 includes, among others, the steps of: positioning and securing the pin 30 in the bores 80 of the bearings 32; positioning and securing the second bearings 48 in the apertures 41 of the projections 19; positioning and securing the second pin 46 in the bores 53 of the second bearings 48; connecting the coupler 162 to the pins 30, 46. Before the following steps are executed, the bearings 32 should be positioned in the apertures 40,43 of the projections 19, 22 for connecting the jaws 14, 16 and, optionally, the collars 34 can be positioned on the third portion 92 of the bearings 32.

The step of positioning and securing the pin 30 in the bores 80 of the bearings 32 is illustrated with reference to FIGS. 1, 4, and 5. An end of the pin 30 is positioned proximate to the outer surface 23 of a projection 22 such that the pin 30 aligns with bores 80 of the bearings 32, where the bearings 32 are positioned in the apertures 40, 43. The pin 30 is inserted through the bore 80 of each bearing 32 such that it extends the distance between the outer surfaces 23 of the projections 22. If the collars 34 are not already positioned on the third portion 92 of the bearings 32, then next, the collars 34 are positioned on the third portion 92 of the bearings 32. Next, the pin 30 is secured into position by aligning the securing slots 39 of the collars 34 with the securing slots 33 of the pin 30. Then, dowels 36 are positioned in the securing slots 39 of the collars 34, the securing slots 112 of the bearings 32, and the securing slots 33 of the pin 30 and fastened into position with fastening nuts 38, thereby securing the pin 30 in the grapple assembly 10.

The step of positioning and securing the second bearings 48 in the apertures 41 of the projections 19 is illustrated with reference to FIGS. 1, 4, and 5. The elongated section 60 of the bearings 48 is positioned proximate to the inside surface 21 of the projections 19. The elongated section 60 is then inserted through the apertures 41 such that the flange 52 of the bearing 48 abuts the inside surface 21 of the projection 19. The securing slots 62 of the flange 52 are then aligned with the securing slots 50 of the projection 19, and then pins 62 are positioned in the securing slots 50, 62 for securing the second bearings 48 to the projections 19 of the first jaw 14.

The step of positioning and securing the second pin 46 in the bores 53 of the bearings 48 is illustrated with reference to FIGS. 1, 4, and 5. An end of the second pin 46 is positioned proximate to the outer surface 20 of a projection 19 such that the second pin 46 aligns with bore 53 of the second bearing 46. The second pin 46 is inserted through the bore 53 of each second bearing 48 such that it extends the distance between the outer surfaces 20 of the projections 19. The second pin 46 is secured into position by aligning the securing slot 70 of the bracket 68 with corresponding securing slots formed in the projection 19, and the fastener 72 is positioned in the slots for securing the second pin 46 into position. Additionally, for securing the second pin 46 into position, the securing slot formed in an end of the second pin 46, opposite of the end having the bracket 68, is aligned with a securing slot formed in the reinforcing mount 63. A securing pin is then positioned in the securing slot of the securing mount 63 and the securing slot of the second pin 46.

The step of connecting the coupler 162 to the pins 30, 46 includes engaging the hook-like aperture 167 with the pin 30 engaging the second recess 168 with the second pin 46. The coupler 162 then can be latched in position with latching hook(s) so that the first hook-like aperture 167 and/or the second opening recess 168 are clamped around the respective pins 30, 46. An exemplary method of connecting the coupler 162 to the pins 30, 46 is provided in abovementioned portions of this application with reference to FIGS. 6 and 7.

INDUSTRIAL APPLICABILITY

The industrial applicability of the connecting and adapting system and method described herein will be readily appreciated from the foregoing discussion. The disclosed system and method may be suitable for use in processes where it is desirable to connect and disconnect a grapple assembly to and from a multiplicity of linkages. For example, many large construction companies and municipalities maintain a fleet of excavators, where the fleet consists of multiple sizes and types of excavators having multiple sizes and types of linkages. Most of these excavators are fitted with a bucket for digging and loading soil. However, it is sometimes desirable to the use excavators for operations other than digging and loading soil. For example, excavators are often used for demolition and cleanup.

When converting an excavator from digging-and-loading mode to demolition-and-cleanup mode, the bucket is disconnected from the linkage of the excavator and, in place of the bucket, a grapple assembly is connected to the linkage of the excavator. The present system and method facilitates this converting process by adapting the grapple assembly for connecting a multiplicity of sizes and types of linkages, including quick couplers, located on the excavators within the fleet. The present system and method also facilitates this converting process by maintaining the interconnection between the upper and lower jaws of the grapple assembly while the grapple assembly 10 is disconnected from the excavator.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A grapple assembly, comprising:

first and second opposed jaws, each jaw having a connected end and a free end, each connected end including a projection having first and second sides and at least one aperture, the aperture of the first jaw being axially aligned with the aperture of the second jaw;

a bearing having a first end and a second end, the bearing comprising:

an elongated section extending between the first and second ends of the bearing, the elongated section positioned in the aperture of each jaw for connecting the jaws together;

a flange having an outer rim with a locking surface thereon, the flange positioned proximate to the first end of the bearing for abutting the first side of the projection of the first jaw; and a bore extending through the bearing;

a pin positioned in the bore of the bearing;

a collar positioned on the second end of the bearing for abutting the first side of the projection of the second jaw such that the second sides of the first and second jaws are in face-to-face relation and the projections are located between the flange and the collar; and an element located on the first side of the projection of the first jaw, the element engaging the locking surface of the outer rim of the flange for locking the bearing to the first jaw such that the bearing and the first jaw rotate together, wherein the second end of the bearing includes a securing slot, the pin includes a securing slot, and the collar includes a securing slot.

2. The grapple assembly of claim 1, comprising a first dowel positioned in the securing slot of the bearing, the securing slot of the pin, and the securing slot of the collar, the first dowel to interlock the bearing, the pin, and the collar.

3. The grapple assembly of claim 2, wherein the element of the first jaw, the bearing, the pin, and the collar rotate together.

4. The grapple assembly of claim 1, wherein the second end of the bearing includes a second securing slot and the collar includes a second securing slot.

5. The grapple assembly of claim 4, comprising a second dowel positioned in the second securing slot of the second end of the bearing and the second securing slot of the collar, the second dowel to interlock the bearing and the collar.

6. The grapple assembly of claim 1, wherein the elongated section of the bearing includes a first portion having a first diameter and a second portion having a second diameter, the first portion positioned in the aperture of the first jaw and the second portion positioned in the aperture of the second jaw.

7. The grapple assembly of claim 6, wherein the elongated section of the bearing includes a third portion having a third diameter, the third portion engaged to the collar.

8. The grapple assembly of claim 1, wherein the projection of the first jaw includes a second aperture.

9. The grapple assembly of claim 8, comprising:

a second bearing having a first end and a second end, the second bearing comprising:

a second elongated section extending between the first and second ends of the second bearing, the second elongated section positioned in the second aperture of the first jaw;

a second flange positioned proximate to the first end of the second bearing for abutting the first side of the projection of the first jaw; and a second bore extending through the second bearing; and a second pin positioned in the second bore of the second bearing, the second pin having a first end and a second end.

10. The grapple assembly of claim 9, comprising a locking bracket having a first end and a second end, the first end of the locking bracket attached to the first end of the second pin, the second end of the locking bracket attached to the second side of the projection of the first jaw such that the projection of the first jaw is located between the second flange and the locking bracket, the locking bracket to prevent the second pin from rotating inside the second aperture.

11. The grapple assembly of claim 9, comprising a collar attached to the second side of the projection of the first jaw such that the projection of the first jaw is located between the second flange of the second bearing and the collar, the first end of the second pin position in the collar.

12. A connecting and adapting system of components for interconnecting first and second opposed jaws of a grapple assembly and for adapting the grapple assembly for connecting to a plurality of linkages, each jaw of the grapple assembly having a connected end and a free end, each connected end includes a projection having at least one aperture, the aperture of the first jaw being axially aligned with the aperture of the second jaw, the components of the system comprising:

a bearing having a first end and a second end and a total length, the second end having first and second securing slots formed therein, the bearing comprising:

an elongated section extending between the first and second ends of the bearing, the elongated section sized for receipt in the aperture of each jaw for connecting the jaws together;

a flange having an outer rim with a locking surface thereon, the flange positioned proximate to the first end of the bearing, the flange to abut the projection of the first jaw; and a bore extending through the bearing;

a pin sized for insertion in the bore, the pin having a securing slot formed therein;

a collar sized for receiving the second end of the bearing, the collar having first and second securing slots formed therein, the collar to abut the projection of the second jaw;

a first dowel sized for receipt in the first securing slot of the bearing, the securing slot of the pin, and the first securing slot of the collar, the first dowel to interlock the bearing, the pin, and the collar; and a second dowel sized for receipt in the second securing slot of the collar and the second securing slot formed in the second end of the bearing, the second dowel to interlock the bearing and the collar.

13. The system of claim 12, comprising:

a second bearing having a first end and a second end, the second bearing comprising:

a second elongated section extending between the first and second ends of the second bearing, the second elongated section sized for receipt in the aperture of the first jaw;

a second flange positioned proximate to the first end of the second bearing, the second flange to abut the projection of the first jaw; and a second bore extending through the second bearing; and a second pin sized for insertion in the second bore of the second bearing, the second pin having a first end and a second end.

14. The system of claim 13, comprising a locking bracket having a first end and a second end, the first end of the locking bracket configured for attachment to the first end of the second pin, the second end of the locking bracket configured for attachment to the projection of the first jaw, the locking bracket to prevent the second pin from rotating inside the aperture.

15. The system of claim 12, wherein the elongated section of the bearing includes a first portion having a first diameter and a second portion having a second diameter, the first portion sized for receipt in the aperture of the first jaw and the second portion sized for receipt in the aperture of the second jaw.

16. The system of claim 12, wherein the elongated section of the bearing includes a third portion having a third diameter, the third portion configured for engagement to the collar.

* * * * *